United States Patent [19]

Gomez

[11] 4,009,843

[45] Mar. 1, 1977

[54] SPRING REWOUND TAGLINE DEVICE WITH SPRING OVERLOAD PREVENTING MEANS

[75] Inventor: Secundino G. Gomez, Los Angeles, Calif.

[73] Assignee: McCaffrey-Ruddock Tagline Corporation, Los Angeles, Calif.

[22] Filed: Sept. 11, 1975

[21] Appl. No.: 612,330

[52] U.S. Cl. ..... 242/107

[51] Int. Cl.[2] ..... B65H 75/48

[58] Field of Search ..... 242/84.3, 107 R, 107.5; 267/179, 57; 185/43

[56] References Cited

UNITED STATES PATENTS

| | | | |
|---|---|---|---|
| 1,495,348 | 5/1924 | Odom | 185/43 |
| 2,303,002 | 11/1942 | Ruddock | 242/107 R |
| 3,353,792 | 11/1967 | Aitken | 242/107.3 |

*Primary Examiner*—Harry N. Haroian
*Attorney, Agent, or Firm*—Paul A. Weilein

[57] ABSTRACT

A spring rewound tagline device having an elongated housing on which a cable reel is rotatably mounted by a shaft journalled in a bearing fixed to the housing. The shaft rotates a core structure which in turn tightens a coiled spring arranged around the core structure by winding the coils relative to the bearing. One end of the spring is connected with the core structure by an anchor means, and the other end of the spring is connected with a fixed structure by an anchor means in the form of a frangible shear pin which will break and release this end of the spring, when a predetermined excessive load is placed on the spring, thus preventing damage to the spring as a result of the excessive load.

7 Claims, 3 Drawing Figures

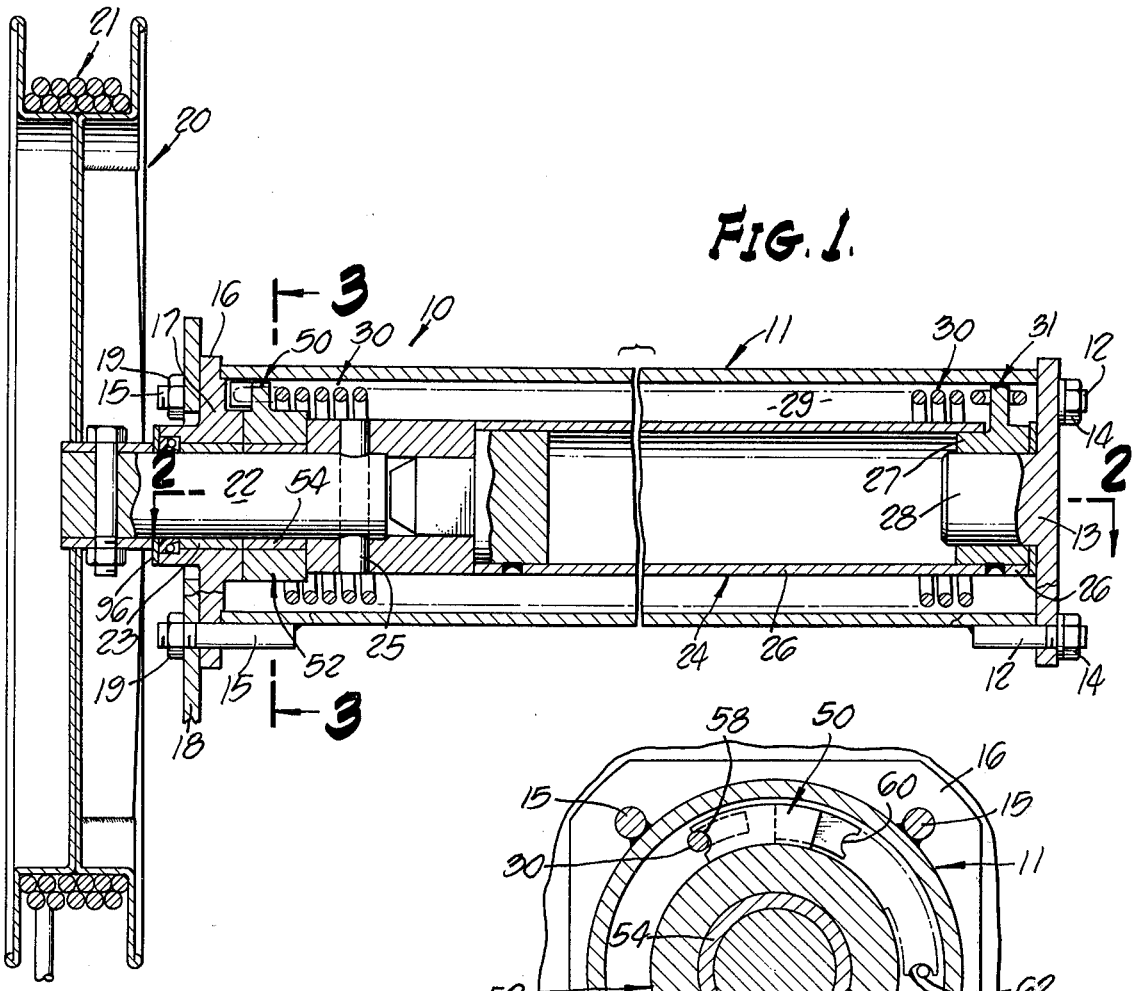
FIG. 1.
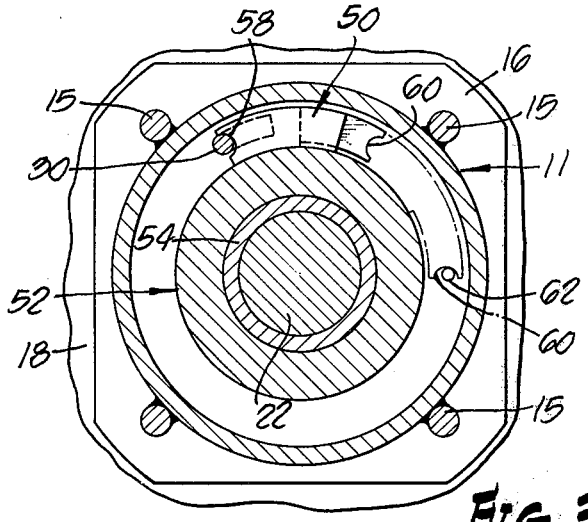
FIG. 3.
FIG. 2.
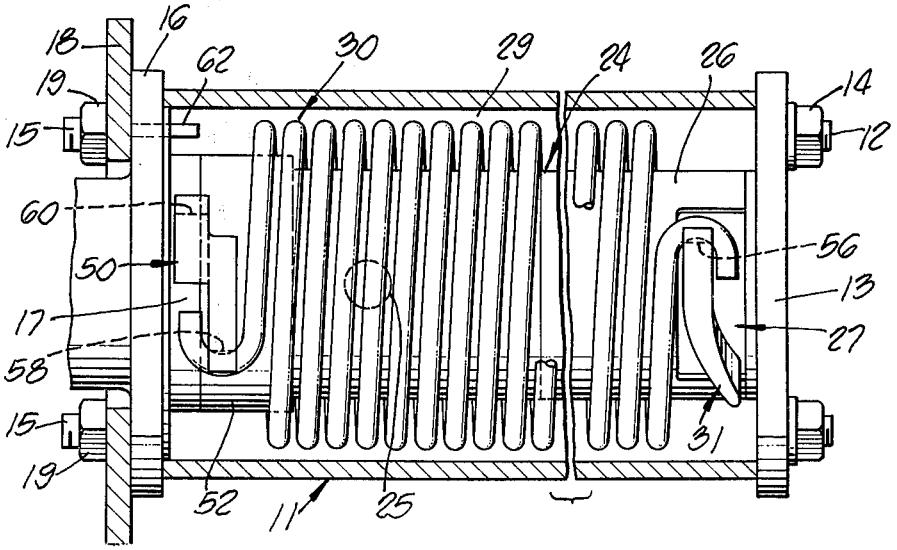

SPRING REWOUND TAGLINE DEVICE WITH SPRING OVERLOAD PREVENTING MEANS

BACKGROUND OF THE INVENTION

1. Field of the Invention

This invention relates generally to a spring rewound tagline device as conventionally employed on cranes, and the like, to maintain tension on a tagline connected to a material handling device, such as a bucket, grab, magnet, and the like, operated by the crane so as to prevent erratic movement of the material handling device, and more particularly relates to unique means for preventing overloading of the tagline rewind spring.

2. Description of the Prior Art

U.S. Pat. Nos. 2,303,002, issued Nov. 14, 1942 to William Ruddock; 2,645,432, issued July 14, 1953 to H. V. Griffitts; and 3,062,479, issued Nov. 6, 1962 to H. V. Griffitts, disclose tagline rewind devices of the general character in which the present invention is utilized.

Briefly, these tagline devices include a reel about which a tagline is wound. The reel is rotatably supported on a shaft which is connected to a rotatable core structure positioned within an elongated cylindrical housing. A coiled torsion spring is disposed about a central core structure coaxially within the housing, one end of this spring being fixedly anchored as by a connection to the housing, while the other end of the spring is connected to the rotatable core structure. As thus arranged, rotation of the reel in a direction to payout the tagline will cause the spring to become wound or tensioned so as to resiliently rewind the reel in the opposite direction as the load on the tagline is relieved.

A difficulty encountered with these conventional and commonly employed tagline devices, as exemplified in the above U.S. patents, is that the ordinary use of a crane may, for example, swing the grab, bucket, magnet, and the like, being manipulated by the crane such a great distance as to excessively wind-up the torsion spring to such an extent as to produce an "overloading" of the spring, which could either break the spring or cause it to become immobilized by being "frozen" about the core structure of the tagline device. Thus, it becomes necessary to disassemble the tagline device in order to replace the damaged spring, and if the spring has become frozen due to the overload, it is additionally necessary to burn the spring, as through a coil or coils with a suitable acetylene torch and the like, until the spring releases its tension and unwinds. As can be appreciated, not only is the downtime of the crane and the man hours required for replacing a spring prohibitively expensive, but the cost of a replacement spring itself is a significant expense.

SUMMARY OF THE INVENTION

Accordingly, it is an object of the present invention to provide a torsion spring rewound tagline device which is so constructed as to prevent overload, and subsequent damage to the torsion spring.

It is another object of the present invention to provide a torsion spring rewound tagline device in which damage due to overloads will be minimized, and of a character which can quickly and easily be repaired without the necessity of having to replace the torsion spring of the device.

It is yet another object of the present invention to provide a torsion spring rewound tagline device provided with means for preventing the torsion spring from being damaged, but which is as rugged and reliable and functions in a comparable manner to conventional torsion rewound tagline devices.

These and other objects are achieved according to the present invention by providing a tagline device in which the torsion spring has one end connected with the rotatable core structure that is connected with the tagline reel, and its other end has an anchored connection with a fixed structure as required for operation of a tagline device, but which is frangible to break and release the spring in response to excessive loading of the spring. In a preferred practice of the invention, the anchored end of the spring is connected to a collar that is rotatably mounted with respect to the core structure, but which rotation is normally prevented by frangible means in the form of a shear pin.

These and other objects and advantages of the invention will become apparent subsequently from the details of construction and operation of the invention as more fully described and claimed below.

BRIEF DESCRIPTION OF THE DRAWINGS

FIG. 1 is a vertical longitudinal sectional view showing a spring rewound tagline device according to the present invention;

FIG. 2 is an enlarged fragmentary horizontal longitudinal sectional view taken generally along the line 2—2 of FIG. 1; and FIG. 3 is a fragmentary transverse sectional view taken generally along the line 3—3 of FIG. 1.

DESCRIPTION OF THE PREFERRED EMBODIMENT

Referring more specifically to the drawing, for illustrative purposes, there is shown in FIG. 1 a spring rewound tagline device 10 which is arranged to be mounted on the boom of a crane for the purposes which are well known in the art, by means of appropriate brackets, U-shaped clamps, and the like (not shown).

The tagline rewind device may vary as to specific structure, but for purposes of illustration has been shown herein as comprising a fixedly mounted hollow housing 11 in the form of an elongate cylinder. At one end, the housing is provided with a plurality of threaded stems 12 which are welded or otherwise secured and project beyond the housing end for connection with an end plate or closure 13 as by means of nuts 14 threaded on the stems 12. At the opposite end, the housing 11 is similarly provided with projecting threaded stems 15 extending through a radially projecting flange 16 of a fixed bearing 17, and through a plate member 18, which may form a fixed support for an associated part of the device, such as a fairlead arm, the flange 16 and plate member 18 being secured to the housing as by nuts 19 threaded onto the stems 15.

A cable reel 20 for a tagline or cable 21 is rotatably mounted by being secured to a shaft 22 which is rotatably supported within a bearing liner 23 of the bearing 17, this shaft projecting inwardly beyond the bearing and being fixedly secured to one end of an elongate core structure 24 as by a key pin 25. The core structure includes an elongated tubular member 26 which has its right end, as shown in FIG. 1, fixedly secured to a rotatably mounted annular bearing member 27 which is rotatably supported on a stub shaft 28 carried by the end plate 13.

As thus arranged, the core structure 24 and the housing 11 are in radially spaced concentric relation and coact to form an elongated annular space 29 within which there is mounted a coiled torsion spring 30. One end of this spring is normally retained against rotation in one direction anchor means to be hereinafter described, while the other end of the spring is connected with the core structure 24 by anchor means in which the spring end is hooked or otherwise attached to an outstanding lug 31 formed on the periphery of the bearing member 27. With this arrangement, it will be apparent that rotation of the reel 20 in a direction to pay-out the cable or tagline 21 will operate through the core structure 24 to rotate the bearing member 27 in a direction to tension the torsion spring 30, and that when the payed-out tagline is relieved, the tensioned torsion spring will act to rewind the tagline on the reel 20.

The annular space 29 also serves to provide a reservoir for an appropriate lubricating oil, and the like, not shown in the drawing, as conventionally employed in tagline devices such as described herein as a lubricating and dampening medium.

The structure thus far described is more or less conventional and forms no part of the present invention except insofar as it constitutes environment for the novel features contemplated herein. The previously mentioned U.S. Pat. No. 3,062,479, issued Nov. 6, 1962 to H. V. Griffitts, is in general exemplary of the structure which has thus far been described.

A primary and important feature of the present invention resides in the provision of an anchor means for one end of the rewind torsion spring 30, which will fracture when the spring is subjected to a predetermined excessive load.

For such purpose, the end of the torsion spring 30, which is disposed adjacent to the bearing 17, is hooked or otherwise connected to an outstanding lug 50 formed on the periphery of a collar 52 having an internal bearing liner 54 rotatably supported on the shaft 22 adjacent the fixed bearing 17. As best shown in FIG. 2, the lugs 31 and 50 are respectively provided with end notches 56 and 58 for seatingly receiving the adjacent hooked ends of the spring 30. The opposite end of the lug 50 is provided with a notch 60 for seating engagement with a stop pin 62 which is supported on the flange 16 of the fixed bearing 17, the stop pin having an end projecting into the annular space 29 in the path of movement of the lug 50, and so that it will be engaged by the lug when the collar 52 is rotated in a clockwise direction, as viewed in FIG. 3.

It is possible that during the operation of the tagline device there may be times when the spring is in a relaxed or non-tensioned condition, and at such times the lug 50 will occupy a position, for example, as shown in full lines in FIG. 3, in which it will be disengaged and in spaced relation to the stop pin 62. However, under stress conditions of the spring, the lug 50 will be biased in a direction to move it into a position of engagement with the stop pin 62 as shown in phantom lines. Thus, during loaded conditions of the spring, the collar will be fixedly anchored against rotation.

To provide against excessive load on the spring and possible damage or breakage, the stop pin 62 is constructed of a frangible material, and so designed with respect to its shear characteristics that when a predetermined excessive load force is exerted on the pin it will shear and thus release the tension of the spring prior to its being damaged or broken. These excessive loads may result from abnormally large swinging movements of the bucket or other material handling device attached to the main cable of the crane or the like.

In the event the pin 62 is sheared, it may be quickly and easily replaced simply by removing the bearing 16 and installing a new shear pin thereon. Thus, down time of the tagline device, and therefore the associated crane, is minimized, as well as the expense of replacing damaged parts. Moreover, by utilizing the present invention expensive spring breakage and spring freezing are eliminated, along with the expense associated with the replacement of the damaged spring.

It is to be understood that the above description of the present invention is susceptible to various modifications, changes, and adaptations intended to be interpreted within the meaning and range of equivalents of the appended claims.

What is claimed is:

1. In a spring-loaded tagline rewind device for mounting on a boom, wherein a rotatable cable reel has a shaft extending axially from the cable reel and a coiled spring arranged surrounding the shaft and having one of its ends connected to the shaft by an anchor means, and with its other end connected with a fixed structure by an anchor means, the improvement being to prevent excessive loading from damaging the spring, the improvement comprising:

one of said anchor means being releasable in response to the load stresses on the spring reaching an increased predetermined magnitude, said anchor means comprising:

a. means confining the associated spring end to movement in a circular path;

b. fixedly mounted stop means in said circular path normally opposing the movement of said spring end in said circular path;

c. said stop means including means responsive to a predetermined load stress on the spring and against said stop means for inactivating said stop means with respect to its opposition to the movement of said spring end in said circular path.

2. An improvement as set forth in claim 1, wherein the stop means includes frangible means for breaking in response to the load stresses reaching the predetermined magnitude.

3. An improvement as set forth in claim 1, wherein the confining means includes a collar rotatably mounted on the shaft and said stop means normally connects the collar with a fixed structure for preventing rotation of the collar, one end of the spring being connected to the collar to be normally immobilized thereby relative to the fixed structure.

4. An improvement as set forth in claim 3, wherein a bearing journals one end of the shaft; the collar is positioned adjacent the bearing; and the stop means mounted on the bearing in engagement with the collar to normally prevent rotation of the collar.

5. An improvement as set forth in claim 3, in which a fixedly mounted housing encloses the shaft; and wherein the stops means comprises a shear pin mounted at one end of the housing and extending inwardly of the housing for restraining engagement with respect to a part carried by the rotatable collar, the collar being connected to the adjacent end of the spring.

6. An improvement as set forth in claim 5, wherein the part carried by the collar comprises a lug extending from the collar and provided with a peripheral recess arranged for engaging with the shear pin and normally restraining the collar from rotation in a direction of rotation of the reel which tends to tighten the spring.

7. An improvement as set forth in claim 1, wherein a fixedly mounted housing encloses the shaft; a rotatable collar is mounted on the shaft; and wherein the releasable anchor means includes frangible means comprising a shear pin mounted at one end of the housing and extending inwardly of the housing for restraining engagement with respect to a part carried by the rotatable collar, the collar being connected to the adjacent end of the spring.

* * * * *